US012092411B2

(12) United States Patent
Horner

(10) Patent No.: US 12,092,411 B2
(45) Date of Patent: Sep. 17, 2024

(54) TRIGGER SYSTEM

(71) Applicant: Tactical Industry Innovations, LLC, Phoenix, AZ (US)

(72) Inventor: Daniel Horner, Westminster, SC (US)

(73) Assignee: Tactical Industry Innovations, LLC, Westminster, SC (US)

( * ) Notice: Subject to any disclaimer, the term of this patent is extended or adjusted under 35 U.S.C. 154(b) by 0 days.

(21) Appl. No.: 18/022,149

(22) PCT Filed: Aug. 19, 2021

(86) PCT No.: PCT/US2021/046792

§ 371 (c)(1),
(2) Date: Feb. 18, 2023

(87) PCT Pub. No.: WO2023/022723

PCT Pub. Date: Feb. 23, 2023

(65) Prior Publication Data

US 2024/0271897 A1 Aug. 15, 2024

Related U.S. Application Data

(60) Provisional application No. 63/161,499, filed on Mar. 16, 2021, provisional application No. 63/062,232, filed on Aug. 19, 2020.

(51) Int. Cl.

| | |
|---|---|
| ***F41A 19/12*** | (2006.01) |
| ***F41A 19/10*** | (2006.01) |
| ***F41A 19/13*** | (2006.01) |
| ***F41A 19/31*** | (2006.01) |

(52) U.S. Cl.
CPC ..... *F41A 19/12* (2013.01); *F41A 19/10* (2013.01); *F41A 19/13* (2013.01); *F41A 19/31* (2013.01)

(58) Field of Classification Search
CPC ..... F41A 19/12; F41A 19/10; F41A 19/25; F41A 19/31; F41A 19/32
USPC ..... 42/69.01–69.2
See application file for complete search history.

(56) References Cited

U.S. PATENT DOCUMENTS 9,689,635 B2 * 6/2017 Krieger ..... F41A 17/64

* cited by examiner

*Primary Examiner* — Reginald S Tillman, Jr.
(74) *Attorney, Agent, or Firm* — KW Law, LLP

(57) ABSTRACT

The trigger may comprise a trigger shoe, a trigger bar, and a sear pack. The trigger bar may comprise an elongate body. The elongate body may comprise a shoe connector. The elongate body may comprise a sear arm. The sear arm may be disposed perpendicularly to the elongate body. The sear pack may be engageable by the trigger bar. The modular seal pack may also be operable by the sear arm. The sear pack may comprise a housing, a pin, and a sear. The sear pack may be installable in the connector. The sear pack may be configured to control or actuate the firing pin system in response to a user actuating the trigger (e.g., firing the striker fired firearm).

15 Claims, 10 Drawing Sheets

TRIGGER SYSTEM

PRIORITY CLAIM

This application is a National Stage Application of PCT/US21/46792 filed on Sep. 23, 2020, which claims priority to and the benefit of U.S. Ser. No. 63/062,232 filed on Aug. 19, 2020 and U.S. Ser. No. 63/161,499 filed on Mar. 16, 2021, all of which are hereby incorporated by reference in their entirety for any purpose.

FIELD

The present disclosure relates to trigger systems and more specifically to a trigger system for a striker fired firearm.

BACKGROUND

Striker fired firearms, like the pistols produced by Glock, Inc. include triggers that are consistent with mass produced injection molded products. As such, there is a need to improve the trigger of striker fired pistols to reduce the trigger pull weight, reduce take up when the trigger is engaged, and increase the crispness of the break of the trigger.

SUMMARY

In various embodiments, a striker fired firearm may comprise a slide, a frame, a barrel, a recoil system, a firing pin system, a connector, and a trigger. The slide may be installable on the frame. The barrel may be installable in the slide. The barrel may also be movable in the slide. The recoil system may be installable in the slide. The recoil system may be configured to engage the slide. In this regard, the recoil system may control the movement of the slide. The firing pin system may be installable in the slide. The connector may be installable in the frame. The connector may be disposed or located below the firing pin system. The trigger may be installed in the frame.

In various embodiments, the trigger may comprise a trigger shoe, a trigger bar, and a sear pack. The trigger bar may comprise an elongate body. The elongate body may define a first end and a second end. The second end may comprise a shoe connector. The shoe connector may be disposed at an angle relative to the centerline of the elongate body. The first end or the elongate body may comprise a sear arm. The sear arm may be disposed perpendicularly to the elongate body. The sear pack may be engageable by the trigger bar. The modular seal pack may also be operable by the sear arm. The sear pack may comprise a housing, a pin, and a sear. The sear pack may be installable in the connector. The sear pack may be configured to control or actuate the firing pin system in response to a user actuating the trigger (e.g., firing the striker fired firearm).

In various embodiments, the pin of the sear pack is installable through the housing. The sear may be rotatably coupled to the housing with the pin.

In various embodiments, the sear may comprise a body and a retaining arm. In various embodiments, the sear may comprise a body defining a first end and a second end. The first end of the body may include a retaining arm. The second end of the body may include a sear hook.

In various embodiments, the retaining arm may be configured to movably engage the firing pin system.

In various embodiments, the housing may include a spring channel. The sear pack may further comprise a spring. The spring may be removably installable in the spring channel. The spring may be in operatively engagement with the sear. In this regard, the spring may control the rotatable motion of the sear and retaining arm.

In various embodiments, a trigger for a striker fired firearm may comprise a trigger shoe, a trigger bar, and a sear pack. The trigger bar may comprise an elongate body. The elongate body may be defined between a first end and a second end or the trigger bar. The second end may comprise a shoe connector. The shoe connector may be disposed at an angle relative to the centerline of the elongate body. The first end may comprise a sear arm. The sear arm may be disposed perpendicularly to the elongate body.

In various embodiments, the sear pack may be engageable by the trigger bar. The sear pack may be operable by the sear arm. The sear pack may comprise a housing, a pin, and a sear. The pin may be installable through the housing. The sear may be rotatably coupled to the housing with the pin. The sear may comprise a body and a retaining arm. The housing may include a spring channel. The spring may be removably installable in the spring channel. The spring may be in operatively engagement with the sear. The spring may be configured to control the rotatable motion of the sear and retaining arm. The sear pack is installable in a firearm connector. The sear pack may be configured to control a firearm firing pin system.

In various embodiments, the sear may comprise a body defining a first end and a second end. The first end of the body may include a retaining arm. The second end of the body may include a sear hook.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein refers to the accompanying drawings, which show exemplary embodiments by way of illustration. While these exemplary embodiments are described in sufficient detail to enable those skilled in the art to practice the inventions, other embodiments may be realized, and that logical, chemical, and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

The present disclosure is directed to a trigger for a striker fired firearm like the pistol manufactured by Glock, Inc. The trigger is generally configured to improve the ballistic the performance and user experience when operating a striker fired firearm.

Figure 1A:
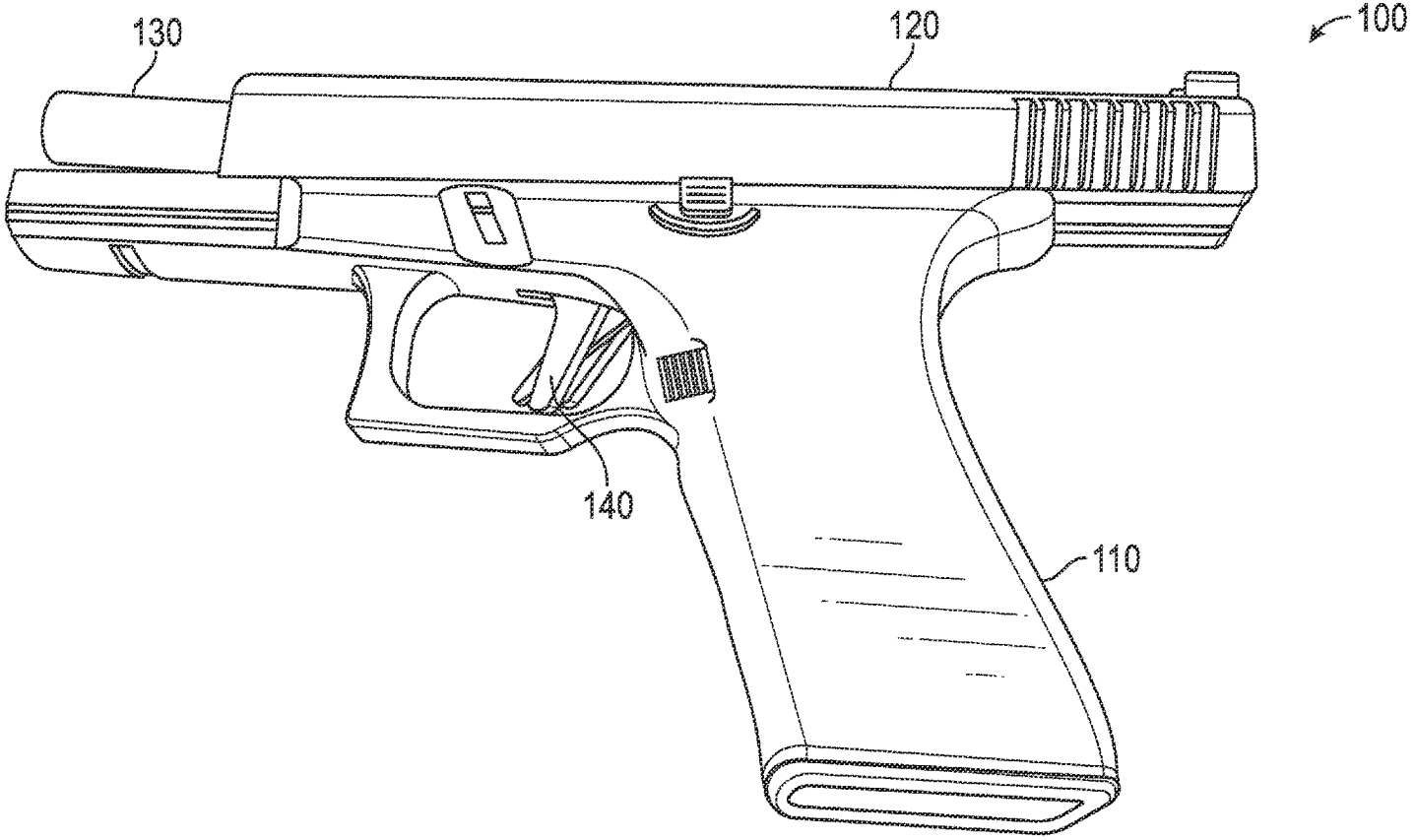
FIG. 1 illustrates a side view of a striker fired firearm, in accordance with various embodiments.
Figure 1B:
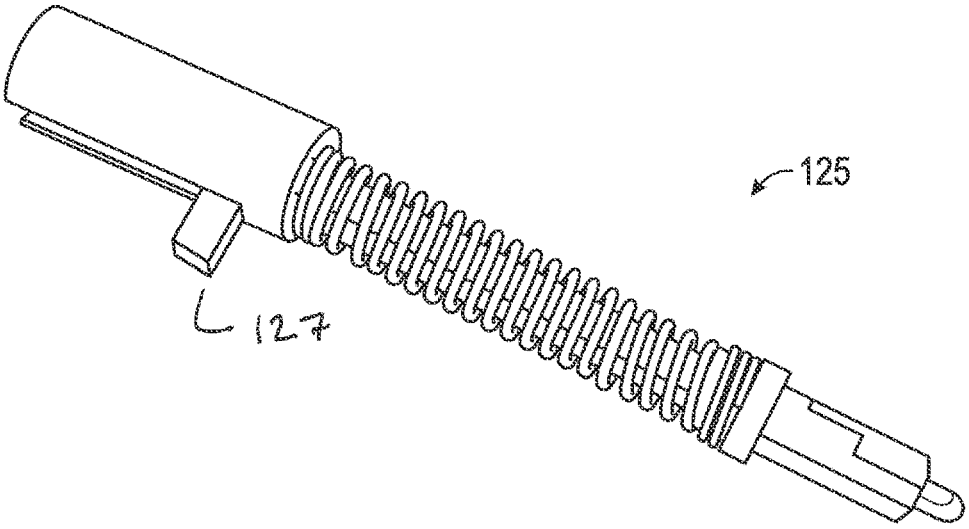
Figure 1C:
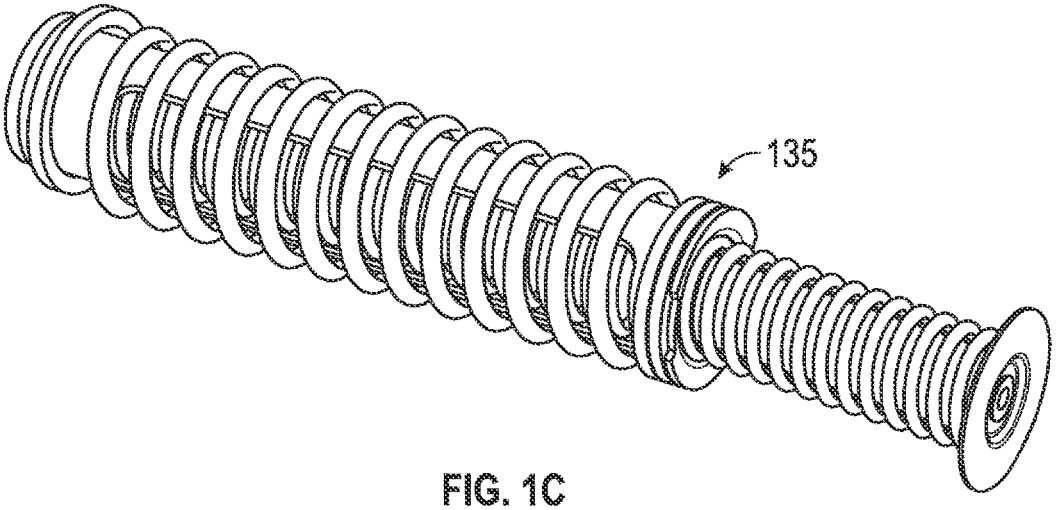

In various embodiments and with reference to FIGS. 1A-1C, a striker fired firearm 100 may comprise a frame 110, a slide 120, a barrel 130, and a trigger 140. Firearm 100 may also comprise a firing pin system 125 and a recoil system 135. Barrel 130 may be slidably installed in slide 120. Firing pin system 125 may be installed in and may be retained in slide 120. Recoil system 135 may also be installed in slide 120. Slide 120 may be slidably installed on frame 110. Trigger 140 may be installed in frame 110. Trigger 140 may be configured to operatively engage firing pin system 125. Firing pin system 125 may comprise a tab 127. Tab 127 may be engageable by trigger 140.

In various embodiments and in operation, firing pin system 125 may be held in a first position (e.g., battery position or a ready to fire position) and may be actuated to a second position (e.g., a firing position) in response to the actuation of trigger 140. Trigger 140 may be movable or actuatable by a user between a first position and a second position. The movement between the first position and the second position allows the firing pin system to move forward and strike a round of ammunition in barrel 130.

Figure 2A:
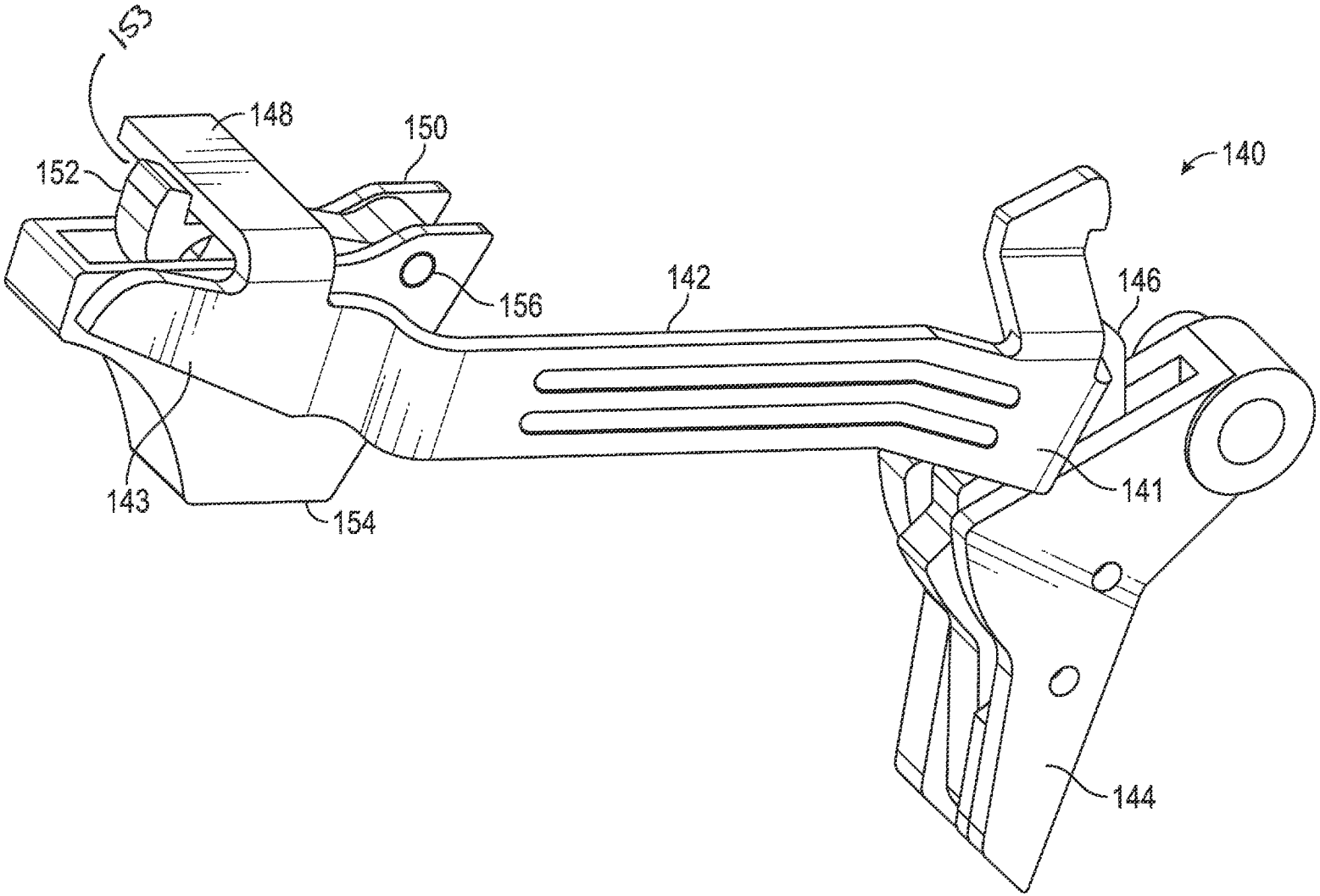
FIG. 2A illustrates a back perspective view of a trigger, in accordance with various embodiments.
Figure 2B:
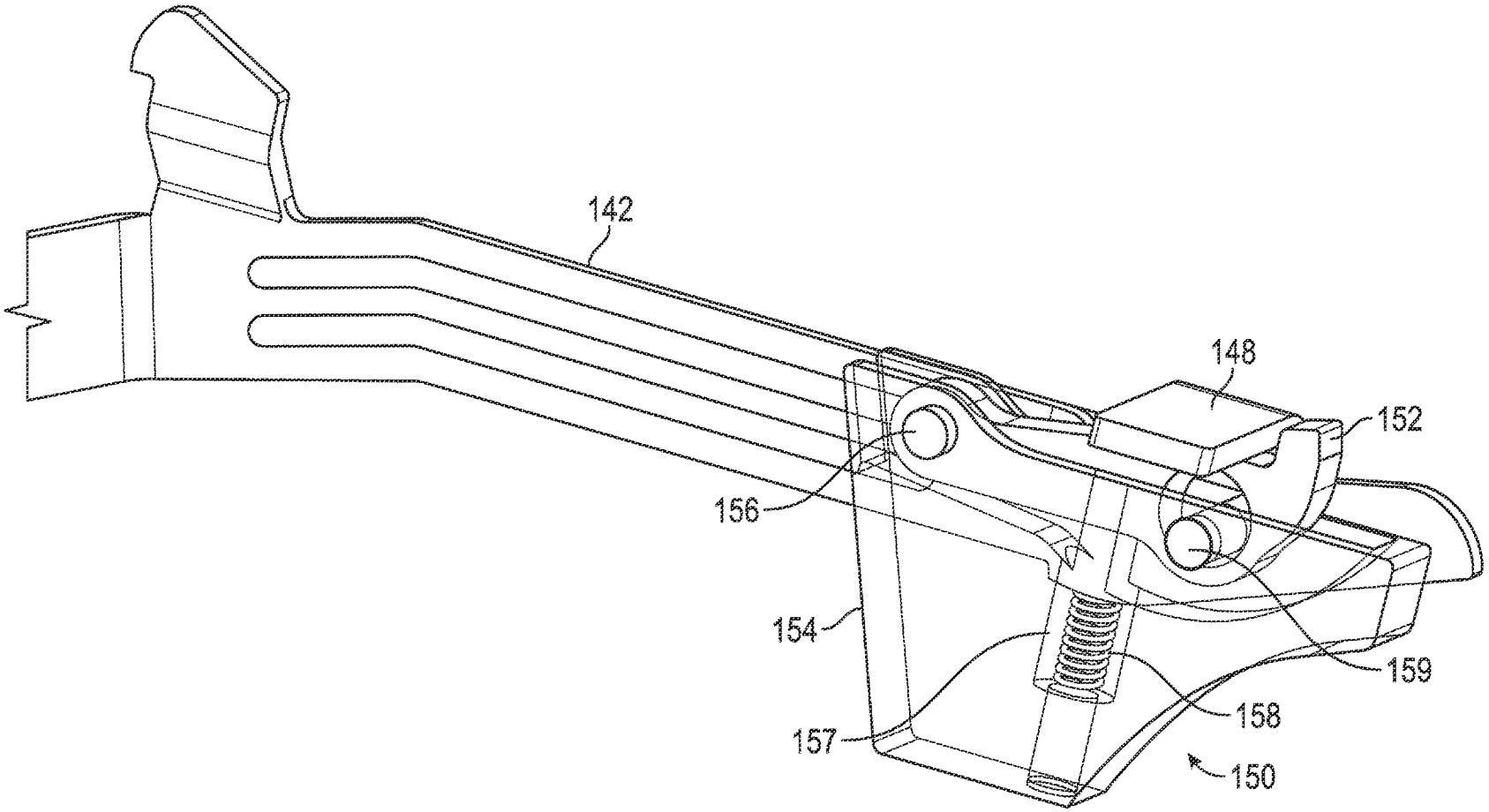
FIG. 2B illustrates a side perspective view of a first trigger bar and sear pack, in accordance with various embodiments.

In various embodiments and with reference to FIGS. 2A-2B, trigger 140 may comprise a trigger bar or elongate body 142, a shoe 144 and a sear pack 150. Elongate body 142 may comprise a shoe connector 146. Shoe connector 146 may be operatively coupled to or formed in an end (e.g., a second end) of elongate body 142. Shoe connector 146 may be disposed at an angle relative to elongate body 142 (e.g., an angle relative to the longitudinal axis of elongate body 142). Elongate body 142 may comprise a sear arm 148. Sear arm 148 may be operatively coupled to or formed in an end (e.g., a first end) of elongate body 142. Sear arm 148 may be disposed at an angle substantially perpendicular to elongate body 142 (e.g., substantially perpendicular relative to the longitudinal axis of elongate body 142).

In various embodiments, shoe 144 may be coupled to elongate body 142. Sear arm 148 may be configured to operatively engage sear pack 150.

In various embodiments, sear pack 150 may comprise a sear 152 and a housing 154. Sear pack 150 may also comprise a pin 156. Sear 152 may be installable in sear housing 154. Sear 152 may be retained in sear housing 154 by pin 156. Sear 152 may be rotatable in housing 154 about pin 156. Sear 152 may comprise a first end and a second end. Sear 152 may include a through hole defined through the body of the sear proximate to the first end. Sear 152 may also comprise a retaining arm 153. Retaining arm 153 may be defined in the second end of sear 152. Retaining arm 153 may be configured to engage the firing pin system of a striker fired firearm. For example, retaining arm 153 may be configured to engage tab 127 of firing pin system 125 as shown in FIG. 1B.

In various embodiments, housing 154 may include a spring channel 157 and a spring 158. Spring channel 157 may be defined in housing 154 such that it is below sear 152 when sear 152 is installed in housing 154. Spring 158 may be installed in spring channel 157. Spring 158 may be configured to operatively engage sear 152. Spring 158 may be configured to bias or load sear 152 in a first direction (e.g., bias or load sear 152 up). In this regard, spring 158 is configured to bias or load sear 152 against firing pin system 125. Moreover, spring 158 may be configured to load retaining arm 153 against tab 127 or firing pin system 125 as shown in FIG. 1B.

In various embodiments, sear pack 150 may also comprise a travel limit pin 159. The motion of sear 152 may be limited by travel limit pin 159. Sear 152 may include a travel hole defined through the body of sear 152 proximate the second end of sear 152. Travel limit pin 159 may be installable in housing 154 through the travel hole of sear 152. Travel hole may be sized to limit the rotation of sear 152 to facilitate the operation of reset of firearm 100. In this regard, the diameter of the travel hole may be larger than the outer diameter of travel limit pin 159.

In various embodiments and in operation, spring 158 may bias or load sear 152 in a first direction toward the firing pin system. In response to actuation of trigger 140, the translates to the rear of firearm 100, forcing sear 152 to rotate about pin 156 and compressing spring 158. The rotation of sear 152 causes retaining arm 153 to release tab 127 of firing pin system 125, allowing the firing pin to strike a round of ammunition.

Figure 2C:
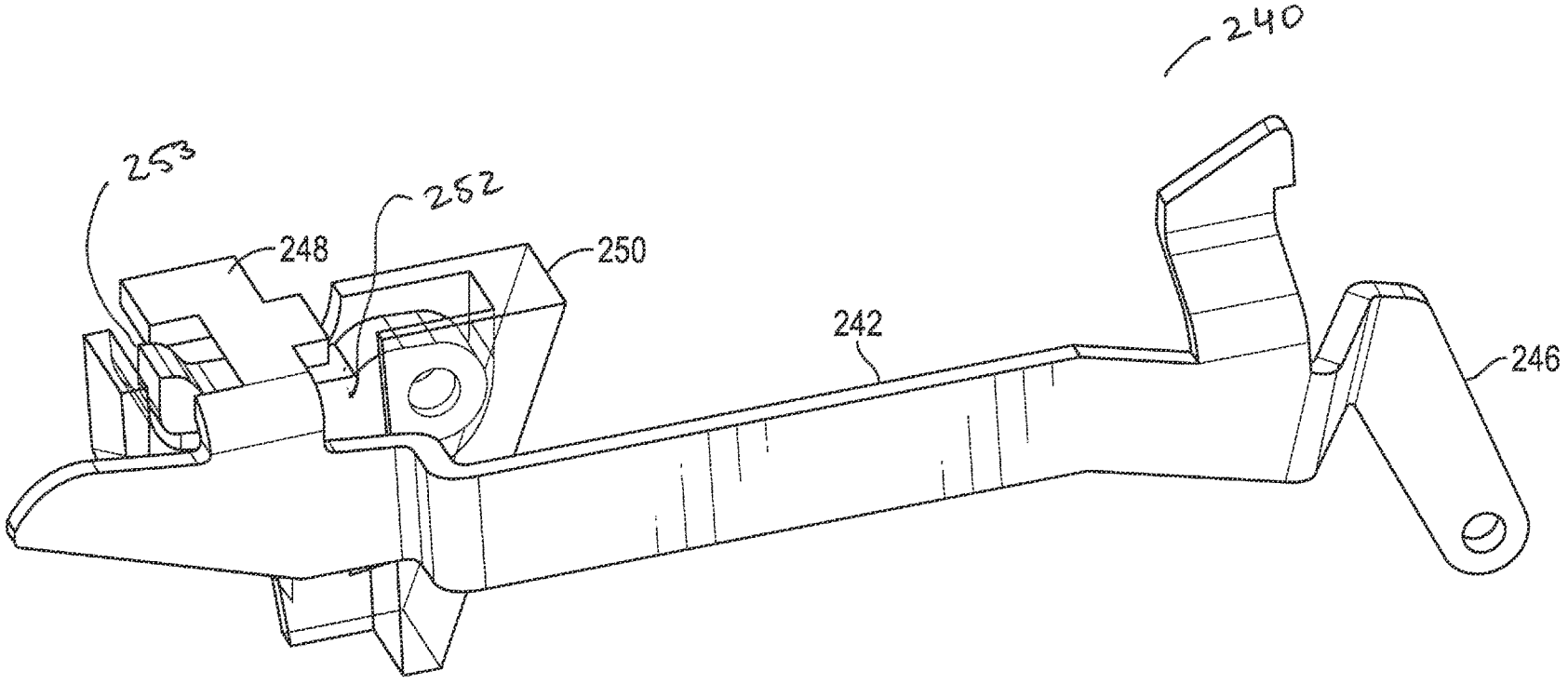
FIG. 2C illustrates a side perspective view of a portion of a second trigger bar and sear pack, in accordance with various embodiments.

In various embodiments and with reference to FIG. 2C, elongate body 242 of trigger 240 may comprise a sear arm 248 that includes a that includes an engagement tab. The engagement tab may be "U" shaped. The engagement tab may engage sear pack 250. In this regard, the engagement tab may be sized to engage and/or surround retaining arm 253 of sear 252. Moreover, the engagement tab my be configured to limit lateral motion of sear 252. The engagement tab may also be configured to limit the lateral motion of elongate body 242.

Figure 3:
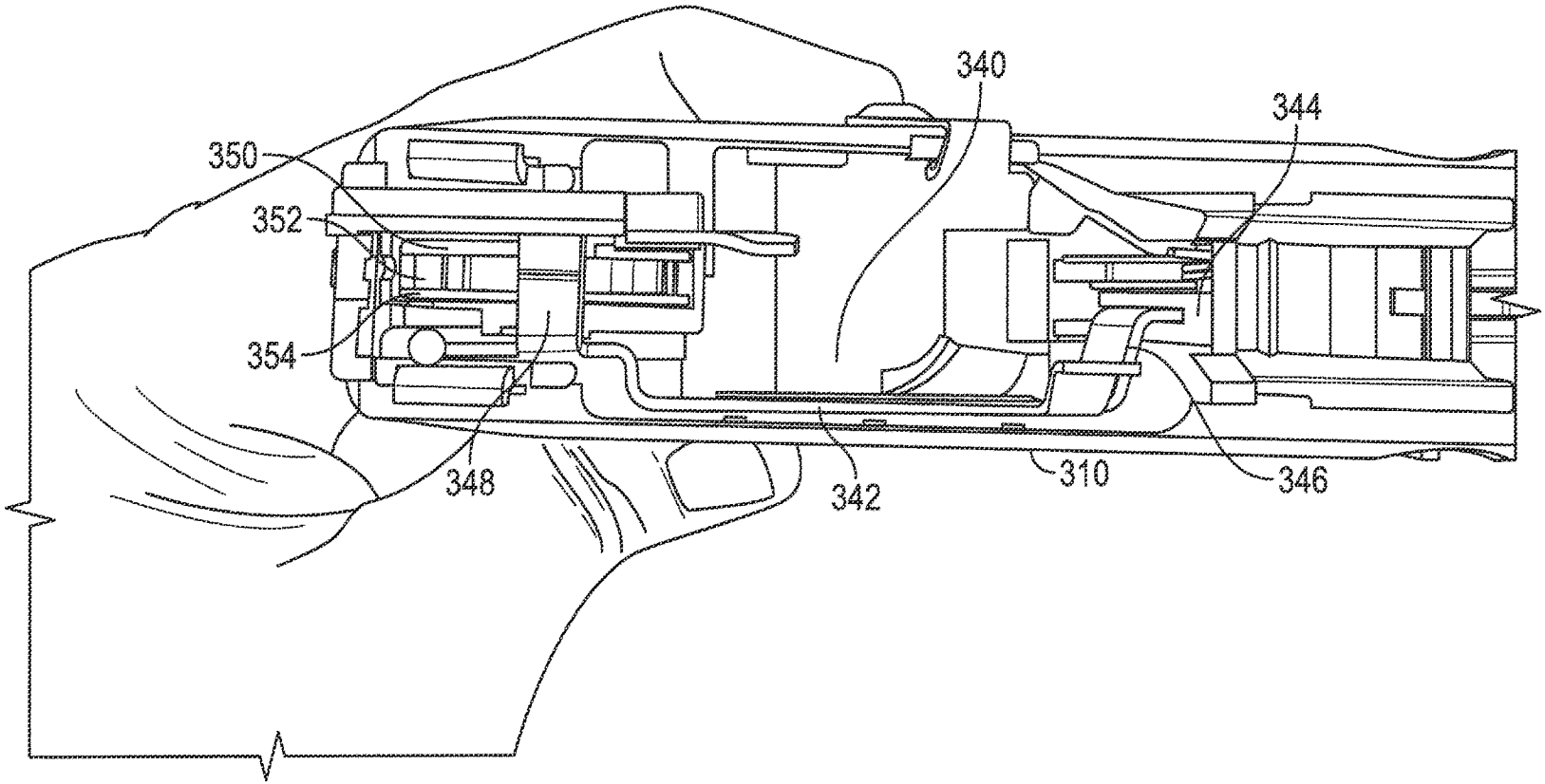
FIG. 3 illustrates a top view of a trigger installed in a striker fired firearm frame, in accordance with various embodiments.

In various embodiments and with reference to FIG. 3, trigger 340 may be installable in frame 310. Shoe 344 may pass through frame 310 so that it is accessible to the user. As discussed herein, shoe 344 is operatively coupled to the trigger bar or elongate body 342 via shoe connector 346. Housing 354 of sear pack 350 is installable in frame 310. Sear 352 is engageable and actuatable by the sear arm 348.

Figure 4A:
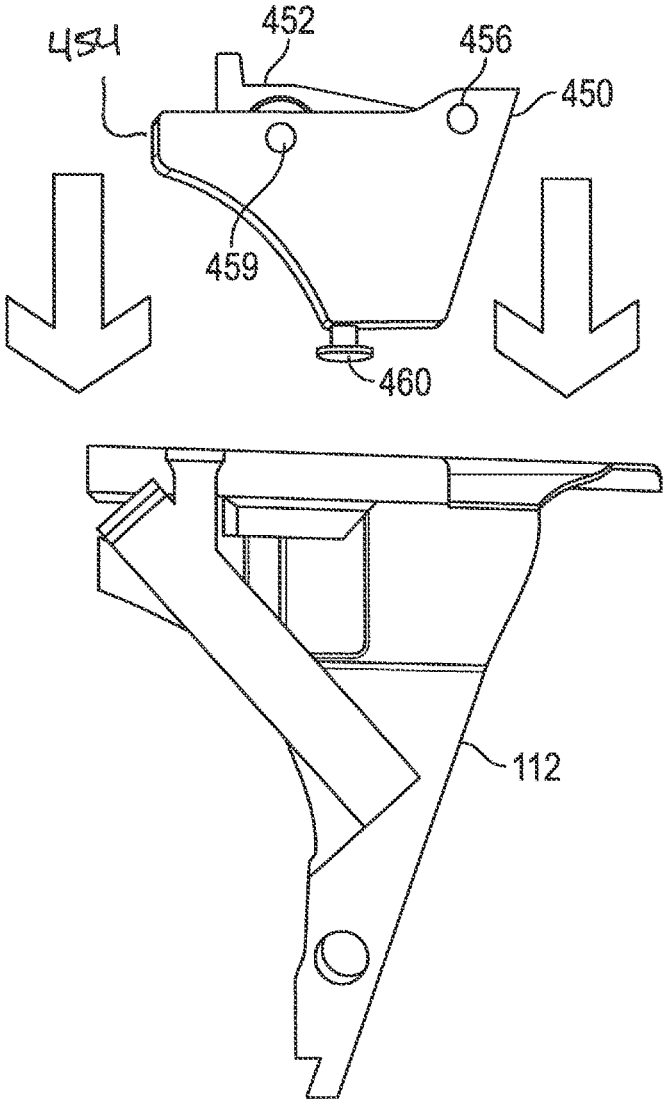
FIG. 4 illustrates a side perspective view of a sear pack being installed in a striker fired firearm connector, in accordance with various embodiments.
Figure 4B:
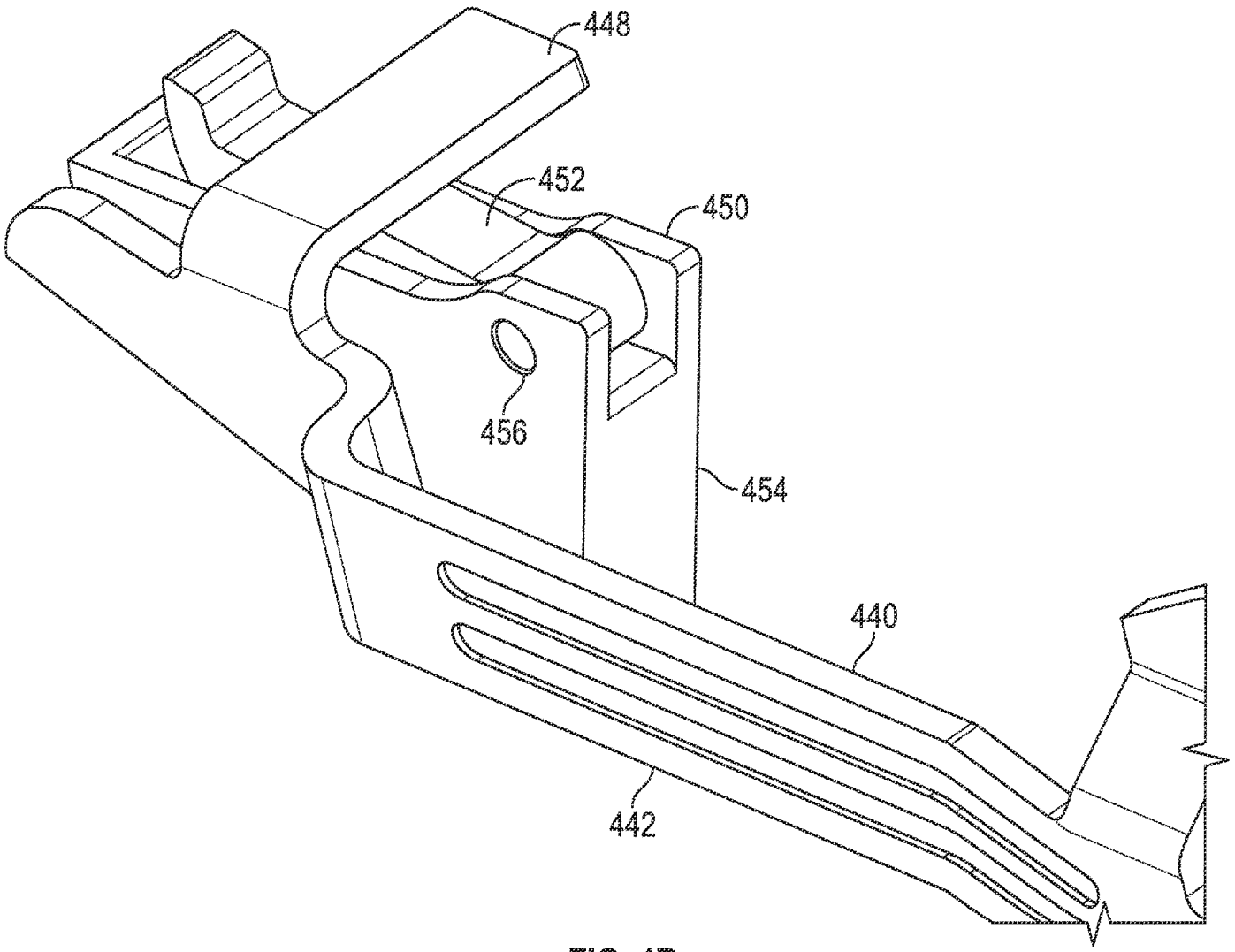

In various embodiments and with reference to FIG. 4A-4B, sear pack 450 may be installable in connector 112 of the frame of the firearm. Pin 456 and travel limit pin 459 may fit flush in housing 454. In this regard, there is no interference between the connector cavity and sear pack 450. Sear pack 450 and, more specifically, housing 454 may be retained in connector 112 with housing screw 460. During installation, housing 454 may be positioned in connector 112 and secured to connector 112 by tightening housing screw 460. Sear 452 may protrude above housing 454 and connector 112 such that trigger 440 and, more specifically, trigger bar or elongate body 442 and sear ram 448 may actuate sear 452.

Figure 5A:
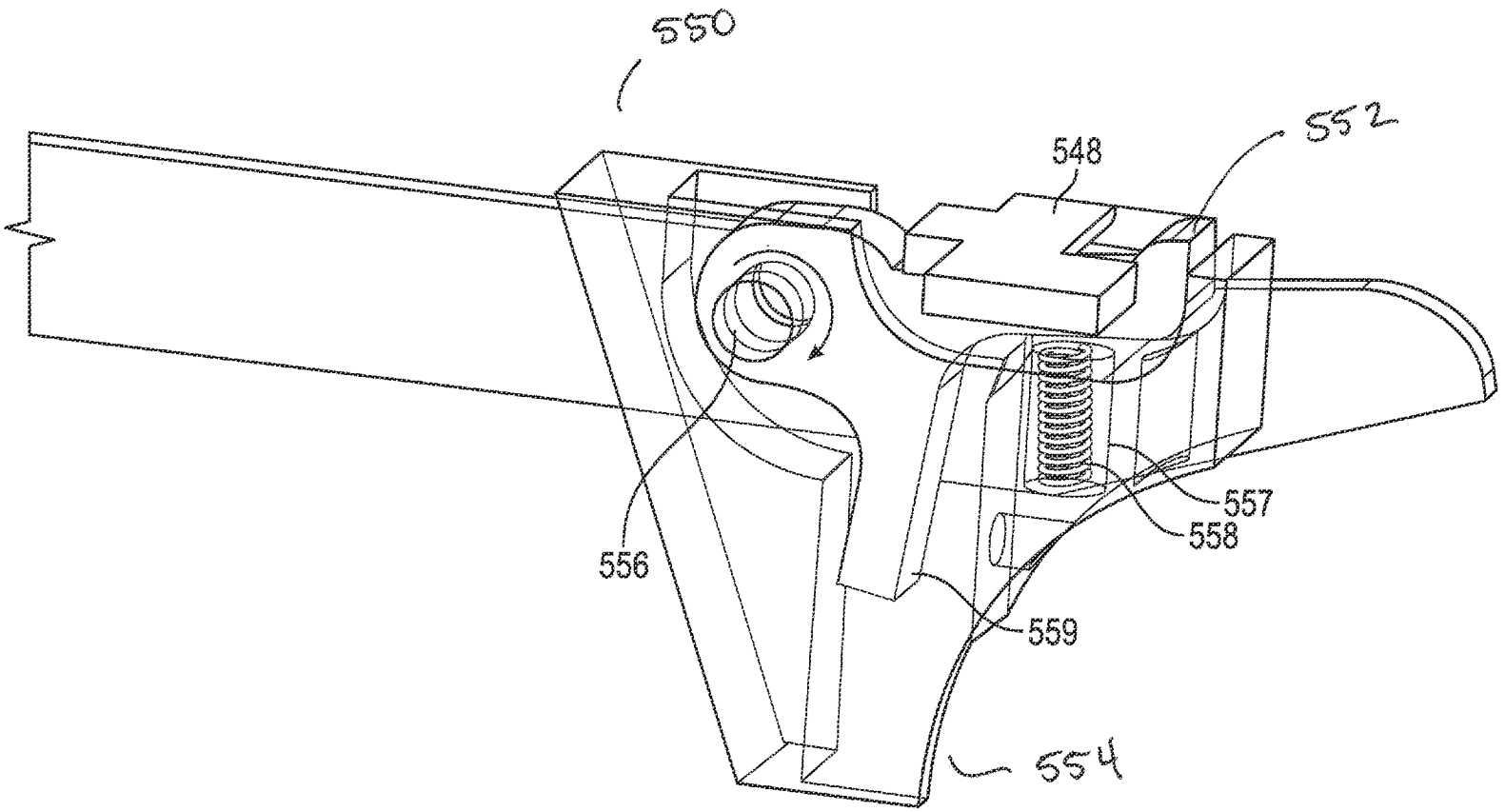
FIG. 5A illustrates a side perspective view of a portion of a first trigger bar and a sear pack, in accordance with various embodiments.
Figure 5B:
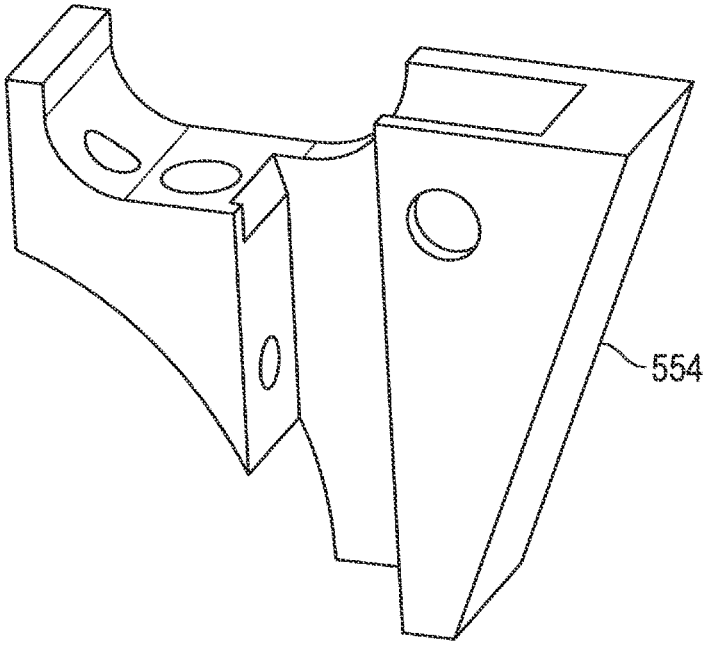
FIG. 5B illustrates a side perspective view of a portion of a second trigger bar and a sear pack, in accordance with various embodiments.

In various embodiments and with reference to FIGS. 5A-5B, sear pack 550 may have housing 554 comprising a pin 556 (e.g., a single pin). Pin 556 may be installable through sear 552. Sear 552 may be rotatable about pin 556 in response to being engaged or actuated by sear arm 548 of the trigger. Sear 552 may comprise a sear stop 559. Sear stop 559 may be configured to limit the rotational motion of sear 552 about pin 556. Sear stop may be configured to contact or engage one or more surface of housing 554 to limit the range of motion or rotation of sear 552. Housing 554 may also comprise a spring channel 557 and a spring 558 that is configured to load or bias sear 552 as discussed herein.

Figure 6:
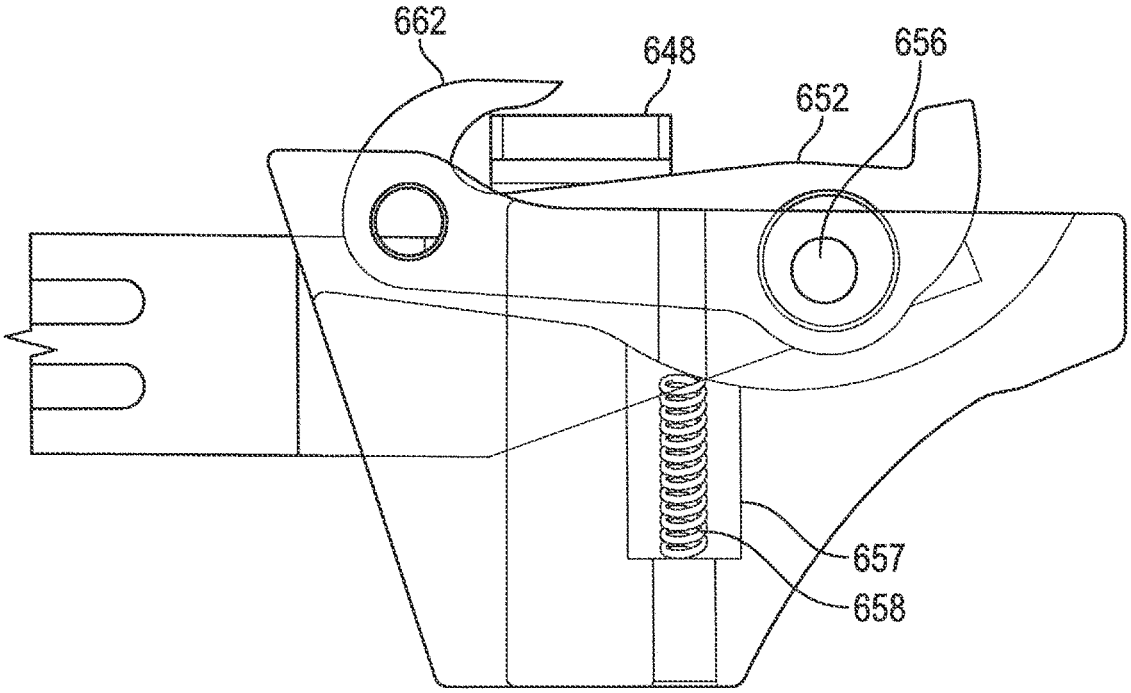
FIG. 6 illustrates a side cross-sectional view of a sear pack with a portion of a trigger bar, in accordance with various embodiments.

In various embodiments and with reference to FIG. 6, sear 652 may comprise a sear arm catch 662. Sear arm catch 662 may be configured to engage sear arm 648 when sear arm 648 is in a first position. Sear arm 648 may be actuated out of engagement with sear arm catch 662 causing sear 652 to rotate. Sear 652 may rotate to compress spring 658 in spring channel 657, until it contacts travel limit pin 656 or a sear stop.

Benefits, other advantages, and solutions to problems have been described herein regarding specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A striker fired firearm, comprising:
- a frame;
- a slide installable on the frame;
- a barrel installable and moveable within the slide;
- a recoil system installable in the slide to control movement of the slide;
- a firing pin system installable in the slide;
- a connector installable in the frame and disposed below the firing pin system; and
- a trigger installable in the frame, the trigger comprising,
  - a trigger shoe;
  - a trigger bar comprising an elongate body defined between a first end and a second end, the second end comprising a shoe connector disposed at an angle relative to a centerline of the elongate body, the first end comprising a sear arm perpendicular to the elongate body; and
  - a sear pack engageable by the trigger bar and operable by the sear arm, the sear pack comprising a housing, a pin, and a sear, wherein the sear pack is installable in the connector and configured to actuate the firing pin system in response to a user actuating the trigger.

2. The striker fired firearm of claim 1, wherein the pin is installable through the housing.

3. The striker fired firearm of claim 1, wherein the sear comprises a body and a retaining arm.

4. The striker fired firearm of claim 3, wherein the retaining arm is configured to movably engage the firing pin system.

5. The striker fired firearm of claim 1, wherein the sear is rotatably coupled to the housing by the pin.

6. The striker fired firearm of claim 1, wherein the housing including a spring channel.

7. The striker fired firearm of claim 6, wherein the sear pack further comprises a spring.

8. The striker fired firearm of claim 7, wherein the spring is removably installable in the spring channel.

9. The striker fired firearm of claim 7, wherein the spring is in operative engagement with the sear to control rotatable motion of the sear and retaining arm.

10. The striker fired firearm of claim 1, wherein the sear comprises a body defining a first end and a second end.

11. The striker fired firearm of claim 10, wherein the first end of the body includes a retaining arm.

12. The striker fired firearm of claim 10, wherein the second end of the body includes a sear hook.

13. A trigger for a striker fired firearm, comprising:
- a trigger shoe;
- a trigger bar comprising an elongate body defined between a first end and a second end, the second end comprising a shoe connector disposed at an angle relative to a centerline of the elongate body, the first end comprising a sear arm perpendicular to the elongate body; and
- a sear pack engageable by the trigger bar and operable by the sear arm, the sear pack comprising a housing, a pin installable through the housing, a sear rotatably coupled to the housing by the pin, the sear comprising a body and a retaining arm, the housing including a spring channel, a spring removably installable in the spring channel, the spring in operatively engagement with the sear to control rotatable motion of the sear and retaining arm, wherein the sear pack is installable in a firearm connector and configured to control a firearm firing pin system.

14. The trigger of claim 13, wherein the sear comprises a body defining a first end and a second end.

15. The trigger of claim 14, wherein the first end of the body includes a retaining arm, and wherein the second end of the body includes a sear hook.

* * * * *